US007473833B2

(12) United States Patent
Holtfreter

(10) Patent No.: US 7,473,833 B2
(45) Date of Patent: Jan. 6, 2009

(54) TROMBONE STAND

(76) Inventor: Jonathan Holtfreter, 467 Pine Brae Dr., Ann Arbor, MI (US) 48105

( * ) Notice: Subject to any disclaimer, the term of this patent is extended or adjusted under 35 U.S.C. 154(b) by 189 days.

(21) Appl. No.: 11/335,117

(22) Filed: Jan. 19, 2006

(65) Prior Publication Data

US 2006/0196341 A1 Sep. 7, 2006

Related U.S. Application Data

(60) Provisional application No. 60/658,191, filed on Mar. 3, 2005.

(51) Int. Cl.
*G10D 7/10* (2006.01)

(52) U.S. Cl. ..... 84/387 A; 84/387 R

(58) Field of Classification Search ..... 84/387 A, 84/450, 387 R; D17/13, 99
See application file for complete search history.

(56) References Cited

U.S. PATENT DOCUMENTS

| | | | | | |
|---|---|---|---|---|---|
| 751,140 | A | | 2/1904 | Beecroft | |
| 1,541,767 | A | | 6/1925 | Mortensen | |
| 1,570,168 | A | * | 1/1926 | Mortensen | 248/124.1 |
| 1,653,772 | A | | 12/1927 | Knoche | |
| 2,245,883 | A | * | 6/1941 | Walberg | 84/421 |
| 2,559,200 | A | | 7/1951 | Schaf | |
| 3,193,325 | A | | 7/1965 | Wenger | |
| 3,266,766 | A | * | 8/1966 | Linville, Jr. | 248/688 |
| 3,405,587 | A | * | 10/1968 | Meazzi et al. | 84/421 |
| 3,811,357 | A | * | 5/1974 | Stewart | 84/327 |
| 4,036,462 | A | * | 7/1977 | Sheftel | 248/166 |
| 4,065,994 | A | | 1/1978 | Streit | |
| 4,067,527 | A | * | 1/1978 | Streit | 248/123.2 |
| 4,215,838 | A | * | 8/1980 | Gullota | 248/121 |
| 4,572,050 | A | | 2/1986 | Werner | |
| 4,742,751 | A | * | 5/1988 | Cherry | 84/327 |
| 4,986,158 | A | * | 1/1991 | Johnson | 84/327 |
| 4,987,817 | A | * | 1/1991 | Diaz | 84/421 |
| 5,664,758 | A | | 9/1997 | Smith | |
| 5,789,687 | A | | 8/1998 | Johnson | |
| 5,894,098 | A | * | 4/1999 | Hsieh | 84/387 A |
| 6,504,087 | B2 | | 1/2003 | Shulman | |
| 6,693,234 | B2 | | 2/2004 | Smith | |
| 6,759,584 | B2 | | 7/2004 | Sundstrom | |

FOREIGN PATENT DOCUMENTS

| | | | |
|---|---|---|---|
| DE | 3922083 | C1 | 11/1990 |
| DE | 19626847 | A1 | 9/1998 |
| FR | 2772178 | A1 | 8/1997 |

OTHER PUBLICATIONS

English Abstract of DE 3922083 C1.
English Abstract of FR 2772178 A1.
English Abstract of DE 19626847 A1.

* cited by examiner

*Primary Examiner*—Jeffrey Donels
*Assistant Examiner*—Christopher Uhlir
(74) *Attorney, Agent, or Firm*—Brinks Hofer Gilson & Lione

(57) ABSTRACT

A trombone stand provides proper support to the weight of the trombone to prevent strain on the musician, and in particular the spine and connective tissues. The trombone stand generally includes a primary post and two support arms. The primary post supports the weight of the trombone, while the support arms provide lateral support and anterior/posterior support.

22 Claims, 6 Drawing Sheets

TROMBONE STAND

CROSS-REFERENCE TO RELATED PATENT APPLICATION

This patent application claims the benefit of U.S. Provisional Patent Application Ser. No. 60/658,191 filed Mar. 3, 2005.

FIELD OF THE INVENTION

The present invention relates generally to a stand for a musical instrument, and more particularly relates to a stand to be used while playing a trombone.

BACKGROUND OF THE INVENTION

The Applicant has discovered that while playing a trombone, the weight of the instrument tends to cause the musician to lean in such a manner that certain areas of the spine are adversely affected. Generally, many trombone players tend to lean forwardly and laterally to support the unbalanced weight of the trombone.

Accordingly, there exists a need to provide a device which prevents a trombone player from leaning in such a manner to prevent damage to the spine or strain on any portion of the musician's body.

BRIEF SUMMARY OF THE INVENTION

One embodiment of the present invention provides a trombone stand to be used while playing the instrument. The trombone stand provides proper support to the weight of the trombone to prevent strain on the musician, and in particular the spine and connective tissues. The trombone stand generally includes a primary post and two support arms. The primary post supports the weight of the trombone, while the support arms provide lateral support and anterior/posterior support. In particular, one support arm prevents rotation of the trombone laterally away from the musician, i.e. rotation generally about the longitudinal axis of the trombone. The second support arm prevents forward rotation of the trombone, i.e. rotation generally about a horizontal and laterally extending axis.

In this manner, the trombone stand not only supports the weight of the trombone, but restricts the lateral and forward rotation of the trombone caused by its inherently unbalanced nature, thereby protecting against physical strain to the musician.

BRIEF DESCRIPTION OF THE DRAWINGS

The accompanying drawings incorporated in and forming a part of the specification illustrate several aspects of the present invention, and together with the description serve to explain the principles of the invention. In the drawings.

DETAILED DESCRIPTION OF THE INVENTION

Figure 1:
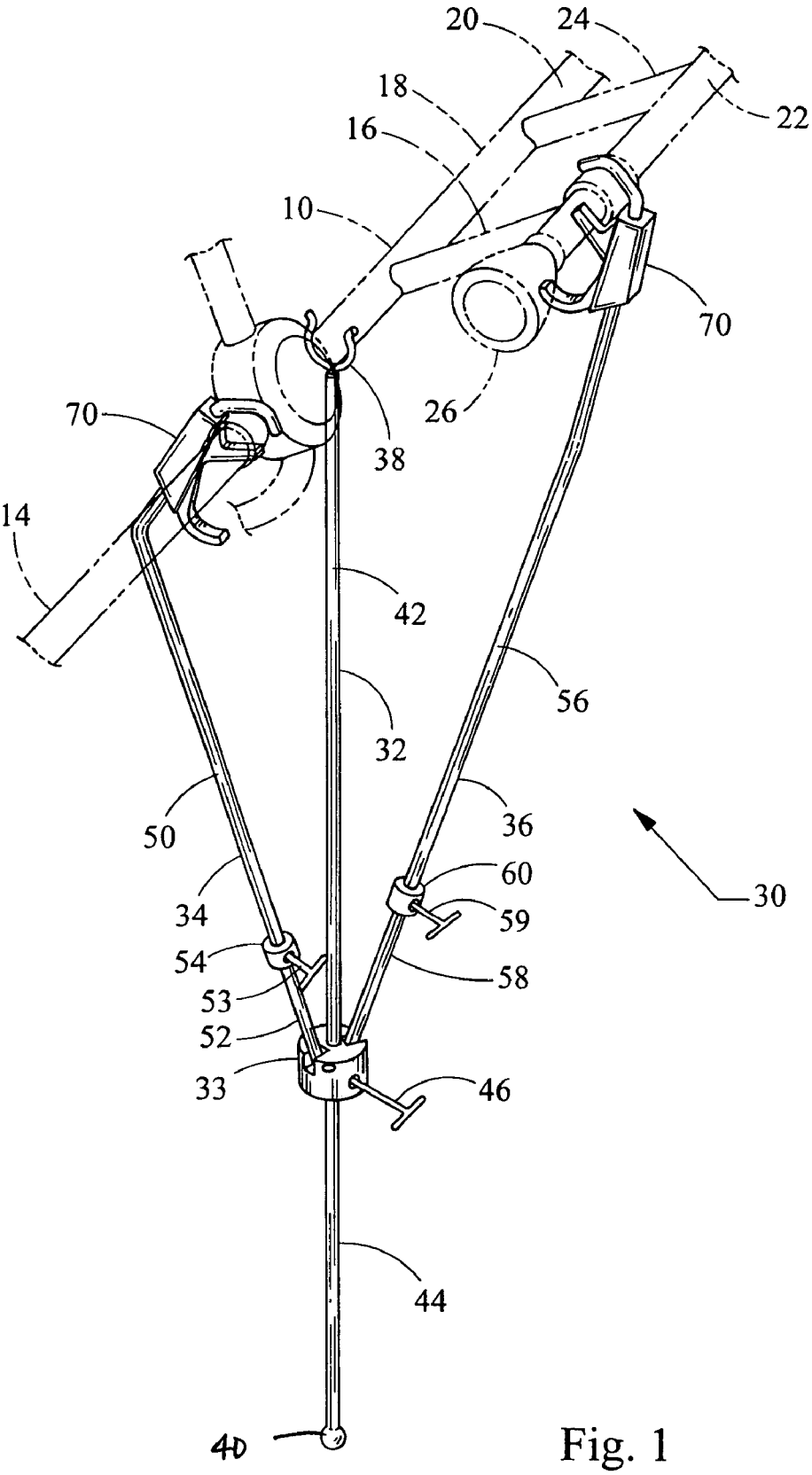
FIG. 1 is a perspective view of a trombone stand constructed in accordance with the teachings of the present invention.
Figure 2:
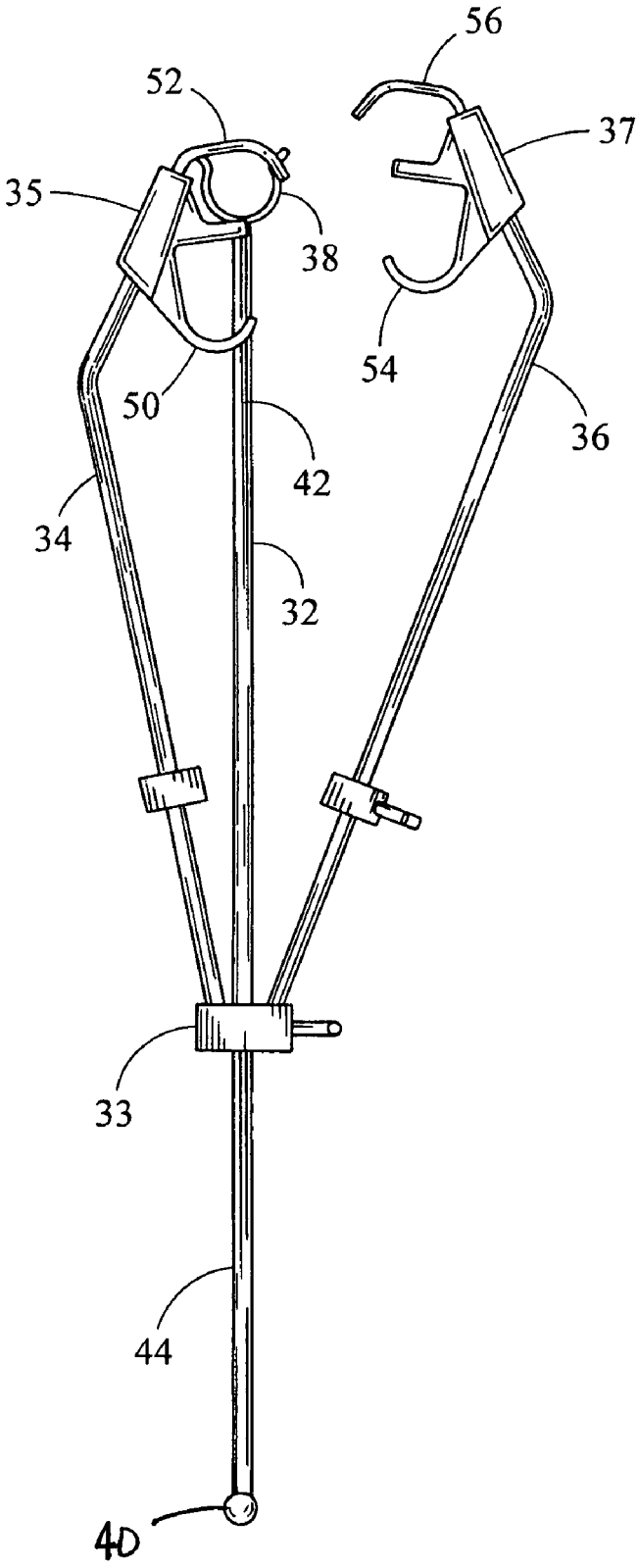
FIG. 2 is a rear view of the trombone stand depicted in FIG. 1.
Figure 3:
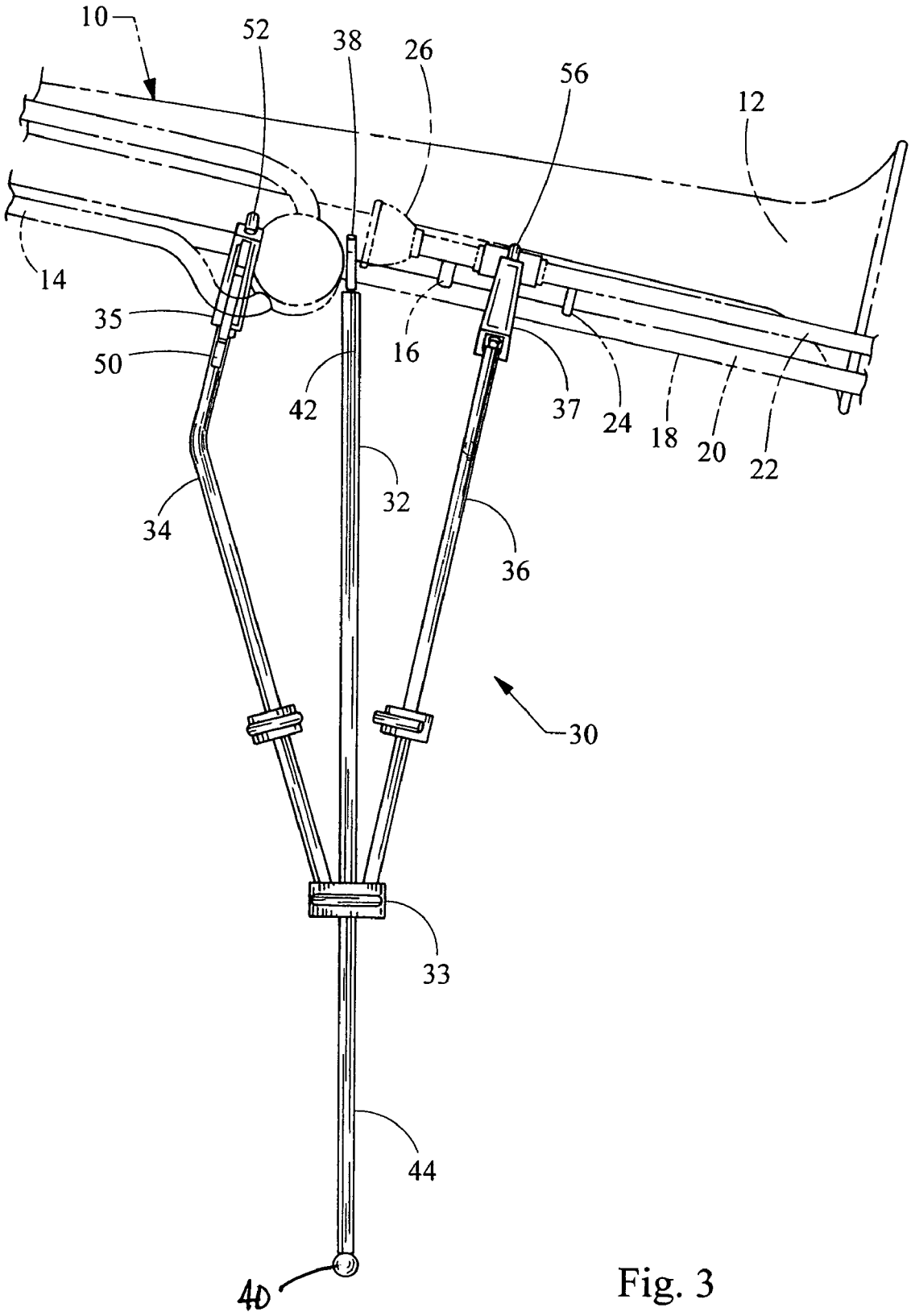
FIG. 3 is a side view of the trombone stand depicted in FIG. 1.

Turning now to the figures, FIGS. 1-3 depicts a trombone stand 30 for supporting a trombone 10 (shown in phantom lines and cut-away), constructed in accordance with the teachings of the present invention. The trombone 10 generally includes a bell 12 (FIG. 3) which extends longitudinally and connects to one end of a crook (not shown). The other end of crook is connected to bell section pipe 14. The bell section pipe 14 is generally positioned vertically below the bell 12, and extends longitudinally forward to a cork barrel 16 which receives a trombone slide 18. The trombone slide 18 generally includes two outer slides 20, 22 which are horizontally spaced apart (i.e. left and right). The outer slides 20, 22 receive corresponding inner slides (not shown) as is known in the art. The outer slides 20, 22 are connected by a slide crook (not shown) at a forward end of the trombone 10, while the opposing ends of the outer slides 20, 22 are supported therebetween by a slide brace 24, and then connected to corresponding portions of the cork barrel 16. One portion of the cork barrel 16 includes a mouthpiece receiver connected to a mouthpiece 26. The forward end of bell section pipe 14 and the cork barrel 16 provide an area for the musician to grasp and support the trombone 10. At the same time, the slide brace 24 allows the user to longitudinally translate the slide 18 (i.e. the outer slide moving over the inner slide) to vary the length of the air pathway and hence control the pitch of the trombone 10.

Generally, this structure of the trombone 10 results in a weight distribution that is offset from the area around the cork barrel 16 where the trombone is normally supported by the musician's hands. The weight is offset forwardly and laterally (from the perspective of the musician), and thus the musician must counteract this imbalance. By way of the present invention, this off-balance is counteracted by a trombone stand 30, thereby minimizing stress on the musician and his or her spine. The trombone stand 30 generally includes a primary post 32 and two support arms 34, 36 attached thereto. The primary post 32 and support arms 34, 36 are joined by a hub 33, as will be described in more detail below. The support arms 34, 36 engage the trombone 10 and are structured to resist the lateral and forward rotation of the trombone 10.

The primary post 32 generally includes an upper rod 42 and a lower rod 44. The upper and lower rods 42, 44 are telescopingly connected through the hub 33, although any known structures may be employed for providing relative adjustment of the rods 42, 44 to vary the height of the primary post 32. Preferably, a latch 46 is provided on the hub 33 at the interconnection of the upper and lower rods 42, 44 to quickly fix the relative positions of the upper and lower rods 42, 44 and provide quick adjustment of the height of the primary post 32. As shown, the latch 46 may comprise a simple threaded fastener 46 extending through one of the rods 42, 44 and selectively engaging the other rod, although other well known latch mechanisms such as quick-connect systems may be readily employed. The lower rod 44 of the primary post 32 includes a lower end 40 that is positioned on the ground, a chair seat, or other surface sufficient to support the weight of the trombone 10. The lower end 40 preferably includes a protective element such as a rubber tip to prevent damage to the supporting base, although numerous other connection ends may be employed such as for use with a special belt (i.e. a pole "jock") or the like.

The upper rod 42 of the primary post 32 includes an upper end having a. U-shaped clip 38 which is structured for selective attachment to the trombone 10, and preferably a portion of the bell section pipe 14. However, it will be recognized by those skilled in the art that the upper end 38 of the primary post 32 may be connected to any portion of the trombone 10 in the area of where the musician normally supports the instrument, but preferably attaches at the bell section pipe 14 or cork barrel 16. The U-shaped clip 38 is sized to permit rotation (horizontal and vertical) of the trombone 10 within the clip 38, while providing adequate vertical support thereto. A protective sleeve may be employed over the clip 38 to protect the trombone 10. It will also be recognized by those skilled in the art that the upper end 38 may comprise a Y-shape or V-shape to support the bell section pipe 14 or the cork barrel 16, and these portions of the trombone 10 could even be provided with a sleeve or other feature which permits quick connection of the post 32 to the trombone 10. Numerous shapes of upper end 38 and various connecting mechanisms or structures will readily be envisioned by those of skill in the art.

The support arms 34, 36 are also adjustable in size/length to permit adjustment of the trombone stand to each particular trombone 10 and musician. Longitudinal support arm 34 generally comprises an upper rod 50 and a lower rod 52 that are telescopingly connected for relative movement therebetween. The interconnection of the upper and lower rods 50, 52 occurs at a joint 54 which includes a threaded fastener 53 serving as a latch for selectively fixing the relative positions of the upper and lower rods 50, 52 and hence the length of longitudinal support arm 34. A lower end of lower rod 52 is pivotally attached to the hub 33, while an upper end of upper rod 50 includes a clamp 70 for engaging the trombone 10, as will be discussed in greater detail below. Similarly, lateral support arm 36 includes an upper rod 56 telescopingly connected to a lower rod 58 through a joint 60 having a latch 59 formed therein for selectively fixing the relative positions of the upper and lower rods 56, 58. A lower end of the lower rod 58 is pivotally connected to the hub 33, while an upper end of the upper rod 56 includes a clamp 70 for engaging the trombone 10.

Figure 4:
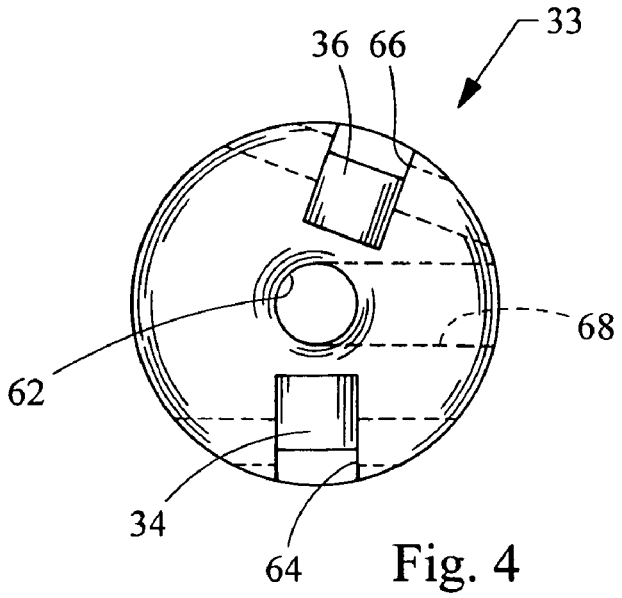
FIG. 4 is a top view of a hub forming a portion of the trombone stand depicted in FIG. 1.

A plan view of the hub 33 has been depicted in FIG. 4. Generally, the hub 33 includes a central aperture 62 for receiving the primary post 32. A first channel 64 is sized to receive the longitudinal support rod 34 while a second channel 77 is sized to pivotally receive the lateral support arm 36. Preferably, the first and second channels 64, 66 are oriented to extend radially at an angle for proper positioning of the support arms 34, 36 on the trombone 10, as will be discussed in more detail below. Generally, the access of channel 64 is aligned with the longitudinal axis of the trombone 10 while the second channel 66 is rotated about 15 degrees from this longitudinal axis. Thus, the first and second channels 64, 66 have axes which are radially separated by about 165 degrees, plus or minus 20 degrees.

Figure 5:
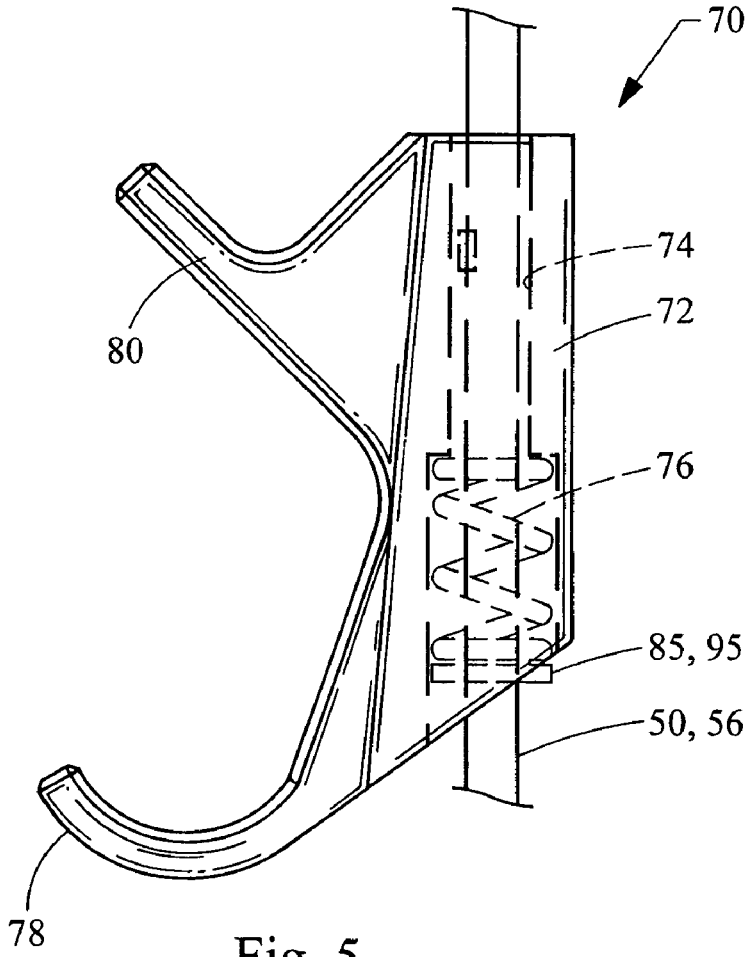
FIG. 5 is a side view of a clip forming a portion of the trombone stand depicted in FIG. 1.
Figure 7:
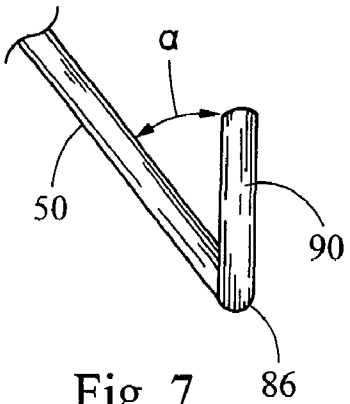
FIG. 7 is a front view of the upper portion of the longitudinal support arm depicted in FIG. 6.
Figure 9:
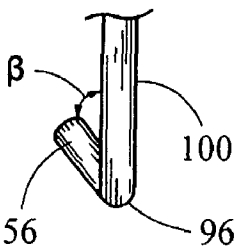
FIG. 9 is a front view of the upper portion of the lateral support arm depicted in FIG. 8.

The clamp 70 positioned at the upper ends of upper rods 50, 56 of the longitudinal and lateral support arms 34, 36 will now be described with reference to FIGS. 5-9. As shown in FIG. 5, the clamp 70 includes a clamp body 72 having an internal bore 74 sized to receive the upper rods 50, 56. An enlarged portion of the bore 74 includes a spring 76 which is compressed between an upper end of the bore and a flange 85, 95 formed on the upper rods 50, 56. A gripping hook 78 is provided on a lower end of the clamp body 72 such that the musician may pull downwardly on the clamp body 70 to release the clamp 70 from the trombone 10 against the force of the spring 76. A lower jaw 80 is also formed in the clamp body 72 and is generally given a V-shaped structure for engaging a lower surface of the trombone 10.

Figure 6:
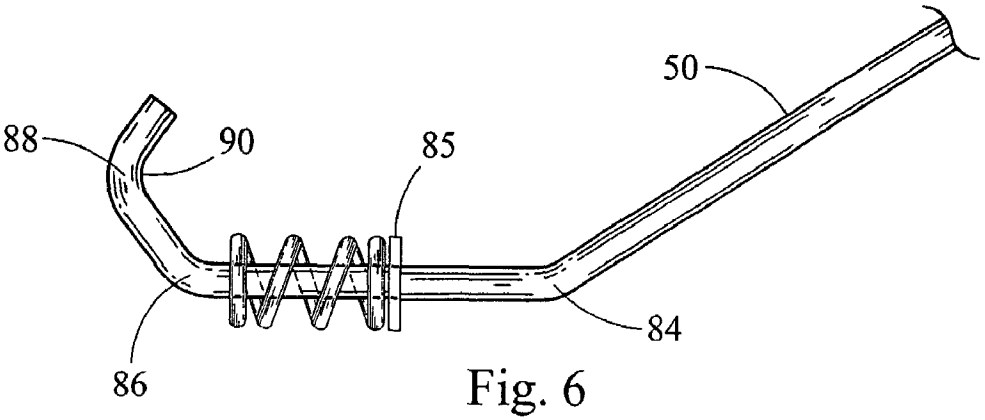
FIG. 6 is a side view of an upper portion of a longitudinal support arm forming a portion of the trombone stand depicted in FIG. 1.
Figure 8:
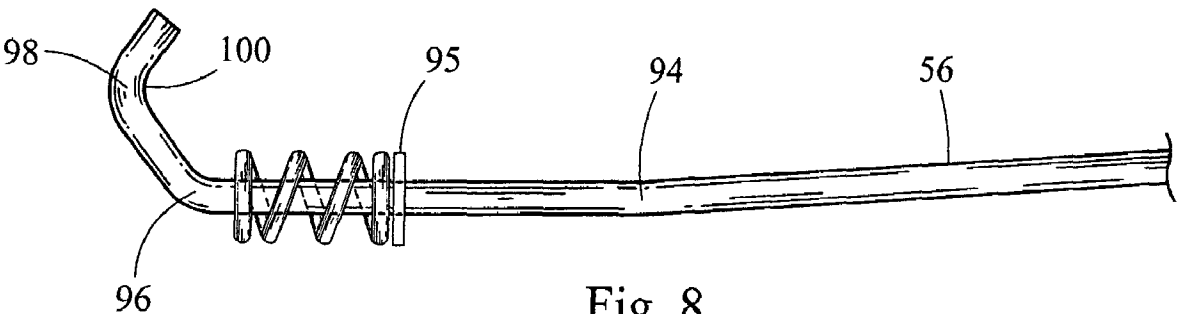
FIG. 8 is a side view of an upper portion of a lateral support arm forming a portion of the trombone stand depicted in FIG. 1.

As best seen in FIGS. 6-9, the free end of the upper rods 50, 56 define an upper jaw 90, 100 which works in combination with the lower jaw 80 to clamp the trombone 10 therebetween. As shown in FIG. 6, the upper rod 50 of the lateral support arm 34 includes a first bend 84, a second bend 86 and a third bend 88. The second bend 86, 88 define a generally V-shaped upper jaw 90. The portion of the rod 50 between the first and second bends 84, 86 generally is positioned within the clamp body 72 and includes the flange 85. As best seen in the end view of FIG. 7, the second bend 86 generally positions the upper jaw 90 at an angle a relative to the main portion of the upper rod 50, $\alpha$ generally being equal to about 45 degrees plus or minus 5 degrees.

Similarly, upper rod 56 of lateral support arm 36 includes first, second and third bends 94, 96, 98. The second and third bends 96, 98 generally define a V-shaped upper jaw 100 which works in conjunction with the lower jaw 80 of the clamp 70. The portion of the upper rod 56 between first and second bends 94, 96 generally extends through the clamp body 72 and includes flange 95 for engaging a spring 76. As best seen in the end view of FIG. 9, the upper jaw 100 is angled relative to the main portion of upper rod 56 by an angle $\beta$, $\beta$ being equal about 40 degrees plus or minus 5 degrees.

Figure 10:
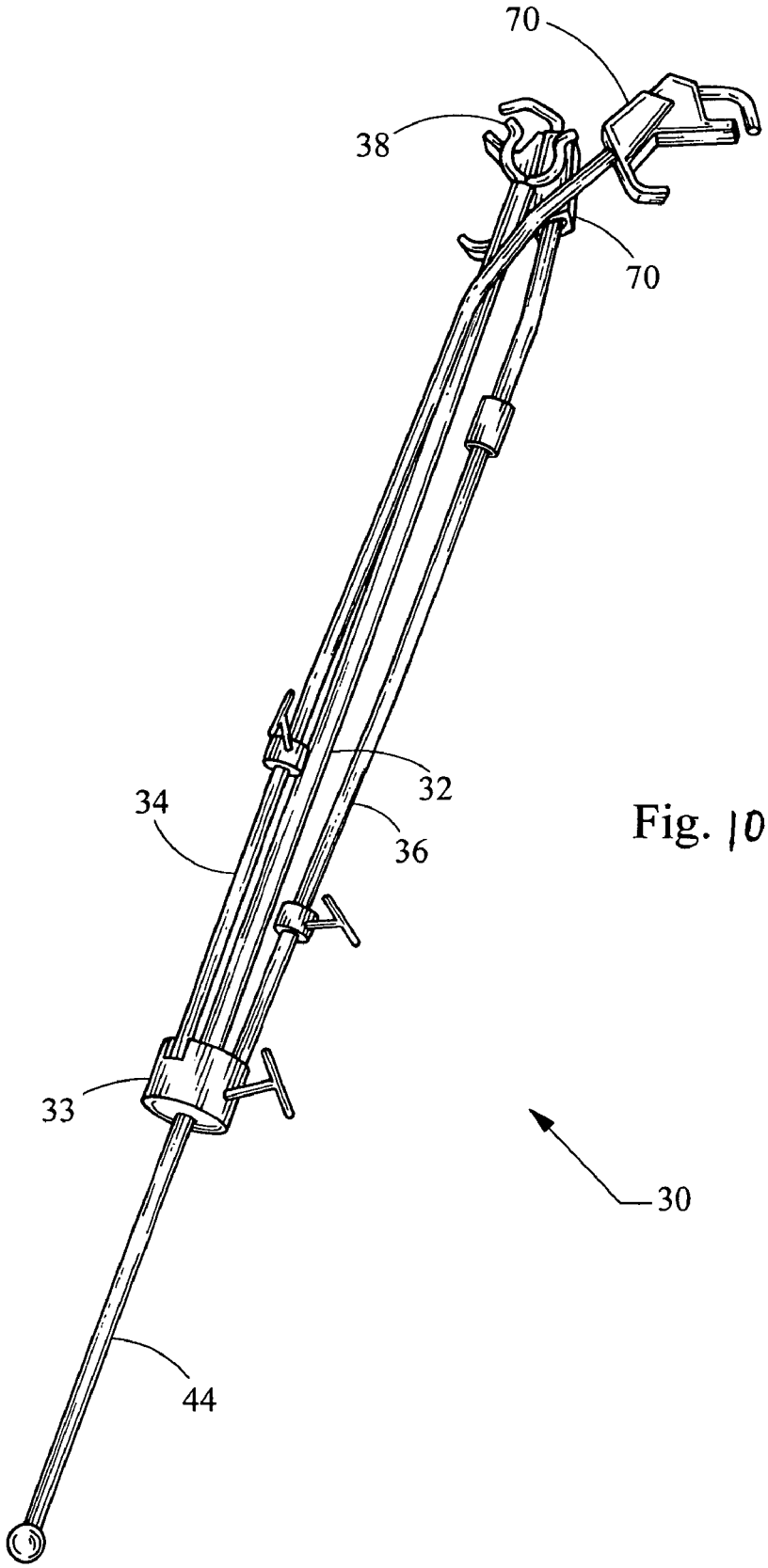
FIG. 10 is a perspective view of the trombone stand of FIG. 1, shown folded into a collapsed configuration.

It has been found that the particular shapes and structures of the upper rods 50, 56 forming the support arms 34, 36, in combination with the telescoping nature of the support arms 34, 36 which are pivotally connected to the primary post 32 through the hub 33, provides an extremely robust trombone stand 30 which may readily be adjusted to fit virtually any size trombone 10 as well as accommodate any musician using the trombone 10. Likewise, the adjustability of primary post 32 permits the stand 30 to be used in a chair, while standing or numerous other positions or situations. Additionally, the pivotal nature of the support arms 34, 36 permits their rotation to a position proximate the primary post 32 as shown in FIG. 10, thereby folding into a collapsed configuration that is well suited for transporting the stand. In fact, the collapsed configuration of the stand 30 fits in most trombone cases along with the trombone 10.

Due to the weight of the bell 12, the center of gravity of the trombone 10 is generally positioned forwardly and laterally (to the musician's left in FIG. 3) of the area where the musician and primary post 32 support the trombone 10. As such, the trombone 10 tends to rotate laterally outward away from the musician (i.e. to the left) and forwardly. The lateral rotation is generally about the longitudinal axis of the trombone 10 and the forward rotation is about a horizontal axis offset from the longitudinal axis.

Accordingly, it can be seen that the longitudinal support arm 34 is connected to the bell section pipe 14 at a position behind (i.e. rearwardly) the connection point of the primary post 32 and the bell section pipe 14 (and behind (rearwardly) the center of gravity of the trombone 10). In this manner, the support arm 34 resists the forward rotation of the trombone 10 about a horizontally and laterally extending axis of the trombone 10. Likewise, the lateral support arm 36 is attached to right side of the cork barrel 18 adjacent mouthpiece 26 and to the right of the connection point between the primary post 32 and the trombone 10 (and to the right of the center of gravity of the trombone 10). In this manner, the lateral support arm 36 resists the laterally outward rotation of the trombone 10. It will be recognized that the longitudinal and lateral support arm 36, 38 can be attached to other portions of the trombone 10 depending on the particular trombone and user, so long as lateral and longitudinal support is provided in a manner that permits translation of the slide 18 and access to mouthpiece 26, while restricting lateral and longitudinal rotation.

It will be recognized by those skilled in the art that the support arms 34, 36 can take many forms and be constructed of many different materials. For example, the support arms 34, 36 could be constructed of either flexible or rigid materials. The support arms 34, 36 could be constructed of flexible and/or elastic material such as ropes or rubber tubing which would provide the requisite support while permitting adjustment of the trombone 10. Further, the upper ends of the support arms 34, 36 could be attached to the trombone 10 in various manners, including magnets, sleeves or quick connect mechanisms. Numerous variations will be readily apparent to those skilled in the art.

Accordingly, it can readily be seen that the instrument stand 30 of the present invention not only supports a majority of the weight of the trombone, but also resists lateral rotation and forward rotation of the trombone 10 to prevent unwanted strain on the musician. At the same time, the primary post permits variation in the height of the stand to support the trombone on various support basis, while the two support arms may be quickly adjusted to permit adjustment of the trombone relative to the musician as well as to adjust the amount of lateral and rearward support which prevent unwanted rotation of the instrument.

The foregoing description of various embodiments of the invention has been presented for purposes of illustration and description. It is not intended to be exhaustive or to limit the invention to the precise embodiments disclosed. Numerous modifications or variations are possible in light of the above teachings. The embodiments discussed were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

The invention claimed is:

1. A trombone stand for supporting a trombone while a musician is playing the trombone, the support stand comprising:

a primary post having a U-shaped clip at an upper end and directly connected to the trombone for supporting a portion of the weight thereof through loose engagement, the trombone rotatable relative to the U-shaped clip and upper end of the primary post in both a forward direction and a lateral direction;

a first support arm connected at one end to the primary post and connected at the other end to the trombone to restrict forward rotation of the trombone; and a second support arm connected at one end to the primary post and connected at the other end to the trombone to restrict lateral rotation of the trombone.

2. The trombone stand of claim 1, wherein the first and second support arms are pivotally attached to the primary post.

3. The trombone stand of claim 1, wherein the first and second support arms are circumferentially spaced relative to the primary post about 155 to 195 degrees.

4. The trombone stand of claim 1, wherein the first support arm is pivotable about an axis generally perpendicular to a longitudinal axis of the trombone.

5. The trombone stand of claim 1, wherein the first support arm is adjustable in length.

6. The trombone stand of claim 1, wherein the second support arm is adjustable in length.

7. The trombone stand of claim 1, wherein the primary post is adjustable in length.

8. The trombone stand of claim 7, wherein the primary post includes an upper rod adjustably connected to a lower rod, the upper and lower rods interconnected via a hub.

9. The trombone stand of claim 8, wherein the first and second support arms are pivotally connected to the hub.

10. The trombone stand of claim 1, wherein the first and second support arms each include a clamp at an upper end to grasp the trombone.

11. The trombone stand of claim 10, wherein the clamp includes an upper jaw adjustable relative to a lower jaw, and wherein the upper jaw is formed by an upper portion of the first or second support arm, the upper portion including bends to form a hook-shape.

12. The trombone stand of claim 11, wherein the lower jaw is formed as part of a main body having a passageway receiving the upper portion of the first or second support arm.

13. The trombone stand of claim 10, wherein the clamp includes an upper jaw adjustable relative to a lower jaw, and wherein the lower jaw is biased towards the upper jaw.

14. The trombone stand of claim 10, wherein each of the first and second support arms include at least one bend structured to permit the clamp to approach the trombone from a lateral side of the trombone.

15. A trombone stand for supporting a trombone while a musician is playing the trombone, the trombone defining a longitudinal axis and a lateral axis, the support stand comprising:

a primary post having a U-shaped clip loosely connected to the trombone at a primary point for supporting a portion of the weight thereof such that the trombone is rotatable relative to the primary post;

a first support arm connected at one end to the primary post and connected at the other end to the trombone at a point longitudinally behind the primary point; and a second support arm connected at one end to the primary post and connected at the other end to the trombone at a point laterally to the side of the primary point.

16. The trombone stand of claim 15, wherein the first support arm restricts rotation of the trombone about the lateral axis.

17. The trombone stand of claim 15, wherein the second support arm restricts rotation of the trombone about the longitudinal axis.

18. The trombone stand of claim 11, wherein the upper jaw is sized and shaped to extend over an upper surface of the trombone.

19. The trombone stand of claim 15, wherein the U-shaped clip is sized to permit rotation of the trombone relative to the clip.

20. The trombone stand of claim 1, wherein the primary post is connected to the trombone along its bell section pipe.

21. The trombone stand of claim 1, wherein the first and second support arms are independently pivotable relative to the primary post.

22. The trombone stand of claim 15, wherein the first support arm is adjustable in length, wherein rotation of the trombone in the longitudinal direction causes the first support arm to adjust its length; and the second support arm is adjustable in length, wherein rotation of the trombone in the lateral direction causes the second support arm to adjust its length.

* * * * *